US008286277B2

(12) United States Patent
Tupper

(10) Patent No.: US 8,286,277 B2
(45) Date of Patent: Oct. 16, 2012

(54) MODULAR POOL COVER SUPPORT DEVICE

(76) Inventor: Richard Tupper, West Yarmouth, MA (US)

( * ) Notice: Subject to any disclaimer, the term of this patent is extended or adjusted under 35 U.S.C. 154(b) by 1227 days.

(21) Appl. No.: 12/071,009

(22) Filed: Feb. 14, 2008

(65) Prior Publication Data

US 2009/0205120 A1 Aug. 20, 2009

(51) Int. Cl.
*E04H 4/00* (2006.01)

(52) U.S. Cl. ..... 4/503; 135/123

(58) Field of Classification Search ..... 4/503, 498; 135/123, 124, 135, 137, 117, 118, 907; 52/86, 52/83, 169.7, 23–26, 169.14; 160/378; 428/109
See application file for complete search history.

(56) References Cited

U.S. PATENT DOCUMENTS 2,144,747 A * 1/1939 Adams ..... 135/138
2,912,703 A * 11/1959 Murphy ..... 4/494
3,424,178 A * 1/1969 Yazaki ..... 135/157
3,461,890 A * 8/1969 Goodrich ..... 135/123
3,534,412 A * 10/1970 Crook ..... 4/503
3,855,643 A * 12/1974 Sanford et al. ..... 4/498
4,135,259 A * 1/1979 Scardenzan ..... 4/498
4,257,132 A * 3/1981 Kerby ..... 4/498
4,404,980 A * 9/1983 Wade ..... 135/123
4,416,928 A * 11/1983 Carl ..... 428/38
4,683,901 A * 8/1987 Mitchell ..... 135/97
5,184,356 A * 2/1993 Lof et al. ..... 4/502
5,259,077 A * 11/1993 Hager et al. ..... 4/498
5,303,527 A 4/1994 Perez et al.
5,970,531 A 10/1999 Demby
6,213,138 B1 * 4/2001 Wimpee ..... 135/121
6,442,773 B1 * 9/2002 Kopyar et al. ..... 4/498
D512,514 S * 12/2005 Calvaruso et al. ..... D25/2
2004/0111795 A1 6/2004 Oke
2007/0199141 A1 8/2007 Johnston

* cited by examiner

*Primary Examiner* — Korie Chan
(74) *Attorney, Agent, or Firm* — Breneman & Georges

(57) ABSTRACT

A modular pool cover support frame is provided having standardized modular components that are easily assembled, disassembled, stored and shipped and when assembled are held together by compressive forces exerted by the weight of the pool cover. The modular support frame includes standardized spanning components and standardized connecting components for connecting the standardized spanning components which together with a tensioning device holds the modular components together employing the weight of standard pool covers and forces exerted on the pool cover.

20 Claims, 15 Drawing Sheets

MODULAR POOL COVER SUPPORT DEVICE

CROSS REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON COMPACT DISC

Not applicable.

REFERENCE TO A "MICROFICHE APPENDIX"

Not applicable.

BACKGROUND OF THE INVENTION

1. Field of the Invention

The invention pertains to a modular pool cover support device for supporting the weight of a pool cover accumulated water and debris without in ground anchoring hooks. More particularly the invention pertains to a portable, storable and reusable pool cover support held together by the compressive forces exerted by the pool cover and accumulated water and debris while the pool cover is deployed during long periods of non use.

2. Description of Related Art Including Information Disclosed Under 37 C.F.R. 1.97 and 1.98

The most popular prior art pool covers in use include straps which are anchored around the periphery of in ground swimming pools utilizing anchoring bolts disposed in the masonry surrounding the pools. These prior art anchoring fixtures provide a suitable support for pool covers during long winter periods when the pool is not in use since they securely maintain the pool cover in place despite the heavy weight of accumulated ice, snow, rain, leaves and other debris that collect on the pool cover in the fall and during the winter.

Referring now to prior art FIG. 1 the most popular swimming pool cover support system 40 is illustrated having a swimming pool cover 42. Swimming pool cover 42 is tensioned in place by straps 44 of swimming pool cover 42 that are held in place by anchoring pins 46 (FIG. 2) over the pool in which the water level 47 has been lowered. Straps 44 include an elastomeric portion or springs or other tensioning devices 43 to adjust to pins 46 which are disposed in masonry 48 which may include surrounding tile or decorative stone work 50. Popular pool covers having such straps include pool covers manufactured by Raner, Loop-Loc, Equator and Arctic Armor.

The prior art has generally avoided anchoring pool covers to coping 52 since coping 52 is held in masonry 48 by a cement 54. Swimming pool cover 42 is designed to cover coping 52 and cement 54 as the admission and freezing of water in cement 54 loosens coping 52 resulting in expensive masonry work. However the problem of openings 56 in masonry 48 present much the same problem of deterioration of coping by the admission and freezing and refreezing of water. Further such openings 56 interfere with the aesthetic appearance of the pool particularly when filled with accumulated winter debris.

The problem with the most popular anchoring bolts is they require a modification of the masonry surrounding the pool. The surrounding masonry must be drilled, tapped or otherwise damaged to accept the anchoring bolts. These anchoring bolts are generally recessed in the masonry in summer months for safety to prevent injury, but such recessed anchors collect water, debris and ice which serves to damage the masonry surrounding the pool due to repeated freezing and thawing of water that accumulates in the recessed anchor openings.

As a result the prior art has sought to solve the problem of utilizing fixed anchoring bolts by providing a portable and modular support system that does not rely upon anchoring bolts fixed in the masonry surrounding the swimming pool. Once such example is Demby U.S. Pat. No. 5,970,531.

A number of drawbacks result from modular support systems. One is complexity of the deployment of the system. Another problem is that if the system arches over the pool any water, ice or snow on the pool cover drains off the pool cover and is lost. Such arching systems include Demby U.S. Pat. No. 5,970,531; Oke Publ No. U.S. 2004/0111795 A1 and Johnston U.S. 2007/0199141 A1. Another problem is the storage of the support system during periods of non use. The more components involved and the greater the amount of bulk the greater the problem of storage and deployment. Finally the problem of modular systems is that suppliers and manufacturers must manufacture and stock a wide variety of modular systems to accommodate the different sizes and shapes of swimming pools in use.

A prior art pool cover assembly having a similar outward appearance to the invention is Scardenzan U.S. Pat. No. 4,135,259. The outward appearance is where the similarity ends as Scardenzan U.S. Pat. No. 4,135,259 requires a separate storage house, complex mechanical linkage systems and is not easily assembled, disassembled and stored by a homeowner without special tools.

Another prior art system is disclosed in Perez, et al. U.S. Pat. No. 5,303,527. Perez, et al. U.S. Pat. No. 5,303,527 describes a pool cover support system that does not require special tools and can be assembled, disassembled and stored by a consumer. Perez, et al. U.S. Pat. No. 5,303,527 further indicates it is made up of a plurality of adjustable frame assemblies capable of accommodating different size pools.

Perez, et al. U.S. Pat. No. 5,303,527 is otherwise mechanically and physically different than the invention. The invention does not only span one direction but instead both longitudinally and transversely the length and width of the pool. The invention further does not attach to the coping of the pool which due to repeated motion of the pool cover can result in the weakening of the cement holding the coping. This constant motion of the pool cover and weakening of the cement holding the coping together results in expensive masonry work in a manner similar to the anchoring bolts used in the most widely used pool cover support system as previously discussed. Finally the invention does not use telescoping adjustable support apparatus since such telescoping members are generally too weak to provide a reliable pool cover support. The invention instead uses modular components to accommodate varying shapes and sizes of pools and supports the pool cover without attachment to coping on opposite edges of the pool.

Consequently there is a recognized need in the art for a modular pool cover support constructed of simple components that can be assembled together to accommodate a wide variety of shapes and sizes of swimming pools that accommodate popular sized pool covers without using anchoring bolts disposed in the masonry surrounding the swimming pool or that require attachment to the coping or decorative tile surrounding the pool. There is further a need for a swimming pool cover with the foregoing attributes that maintains the standard swimming pool cover in a substantially flat condition above the pool so that ice, snow and water can eventually migrate through the standard pool cover to save water.

Finally there is a recognized need for a pool cover made of inexpensive components that can be repeatedly assembled, disassembled and stored that can be utilized by a homeowner without special tools or skills. Further such components should not mar, rust, discolor or otherwise disfigure expensive swimming pool coping or masonry.

SUMMARY OF THE INVENTION

The invention provides a simple inexpensive and easily implemented swimming pool support system for maintaining the swimming pool cover in the same configuration as it would be held by prior art in masonry anchoring systems. The invention further provides various universal components that can be assembled in a variety of configurations to provide an efficient swimming pool support cover that can be assembled to accommodate a wide variety of swimming pool shapes and configurations and can be readily assembled and disassembled without special tools and can be easily stored during periods of non use.

Like an erector set the novel swimming pool support cover includes a standardized group of components that can be assembled and disassembled to accommodate a variety of pool shapes and sizes by a homeowner without using special tools or skills. The first standardized group of components are hollow tubular elements of a predetermined length. The first standardized group of components are tubular which may by square, triangular or substantially cylindrical meaning they may be cylindrical or oval and are hollow to reduce weight and impart high strength to the first standardized group of components. The first standardized group of components may be straight or curved and are designed to mate with a second standardized group of components. The first standardized group of components are preferably composed of stainless steel, galvanized metal or iron alloys coated with elastomeric material or a rust resistant coating so as to not rust or mar pool masonry or coping.

The second standardized group of components include coupling members for coupling sections of the first standardized group of components together to form a variety of shapes and sizes to accommodate a wide variety of swimming pool shapes and sizes. The second group of standardized components are generally L-shaped, T-shaped and X-shaped or cross-shaped but may include star-shaped and various angled configurations to accept the first standardized group of components.

The second standardized group of components similarly are preferably constructed of stainless steel, galvanized metal or iron alloys coated with an elastomeric material or a rust-resistant coating so as to not rust or mar pool masonry or coping. The second standardized group of components are preferably hollow for purposes of weight, but can be solid where the first standardized group of components are designed to slide over the outside surface of the second group of standardized components. The second group of standardized components have openings which are preferably cylindrical or oval openings to accept the ends of the first group of standardized components either internally or externally. The openings of the second group of components can also be square, triangular or any other configuration as long as it accommodates the end of the first standardized components.

A third group of standardized components includes tensioning straps for tensioning the swimming pool cover to the support structure formed by the first and second group of standardized components. The tensioning straps can include a variety of different types of tensioning straps already included in the swimming pool straps of major swimming pool cover manufacturers or various types of buckles, straps of nylon, plastic, leather springs or elastomeric material for tensioning the swimming pool cover to the assembled structure created by the first and second group of standardized components.

The third group of standardized components are one of the more important elements in the three groups of standardized components in holding the first and second group of components together and in accommodating a wide variety of types of pool covers available. The third group of standardized components provides the initial tensioning required to keep the first and second group of components together.

The first and second components are designed to slip together easily but are firmly held together by compressive forces exerted primarily by the weight of the pool cover. In fact the greater the weight on the pool cover the greater the compressive forces and the greater the separation forces required to disassemble the first, second and third components. The first, second and third components once assembled together will hold more weight than the pool cover and as such holds the pool cover in place with a force at least as great and possibly greater than conventional masonry anchored hooks conventionally in use as a result the distribution of weight and forces in the novel components.

Due to the modular nature and standardized components a homeowner can easily assemble, disassemble and store the components of the swimming pool support cover provided in accordance with the invention. Also due to the modular format of the components manufacturers and suppliers do not have to produce and stock an inventory of specialized components necessary to accommodate various types of sizes and shapes of pools.

BRIEF DESCRIPTION OF THE DRAWINGS

Various objects, features and attendant advantages of the invention will become further appreciated by those skilled in the art when considered in conjunction with the accompanying drawing, in which the reference characters designate the same or similar parts throughout the several views, and wherein.

DETAILED DESCRIPTION OF THE PREFERRED EMBODIMENTS INCLUDING THE BEST MODE

Figure 1:
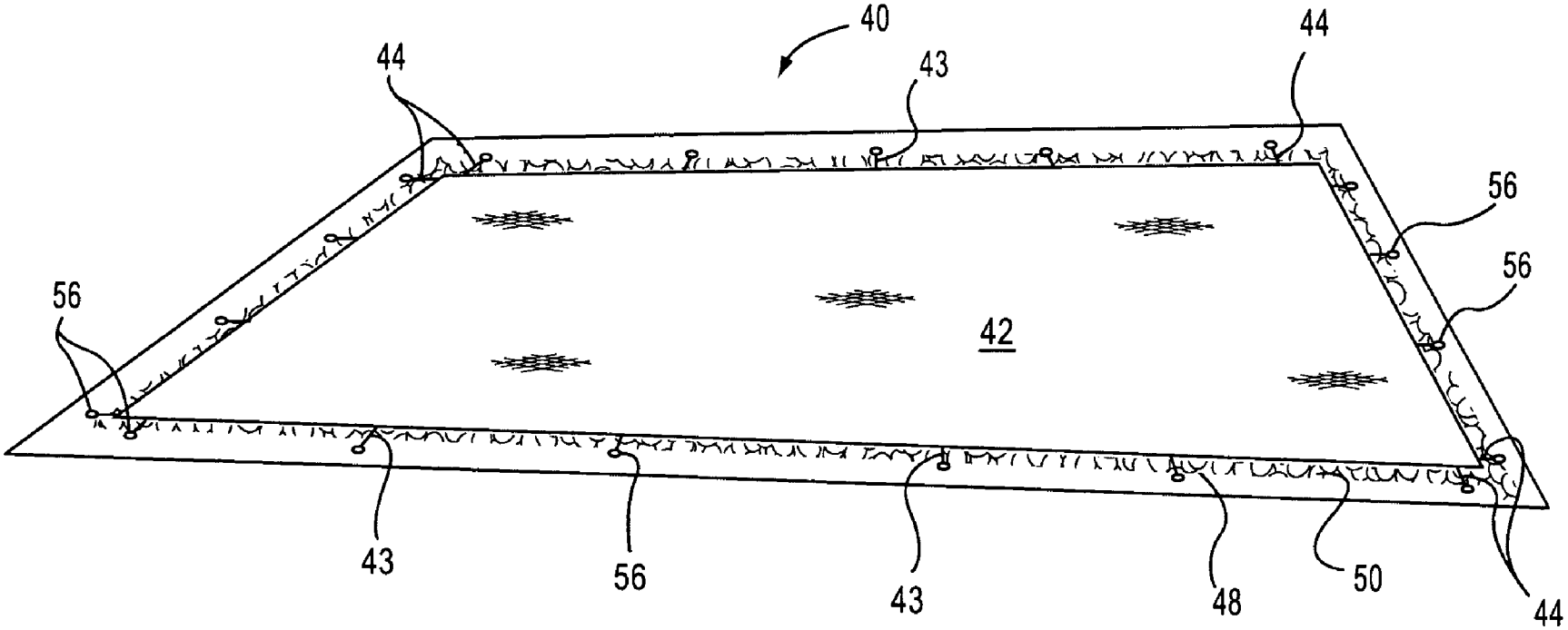
Fig. 1 PRIOR ART
FIG. 1 is a perspective view of a popular prior art pool cover anchoring system.
Figure 2:
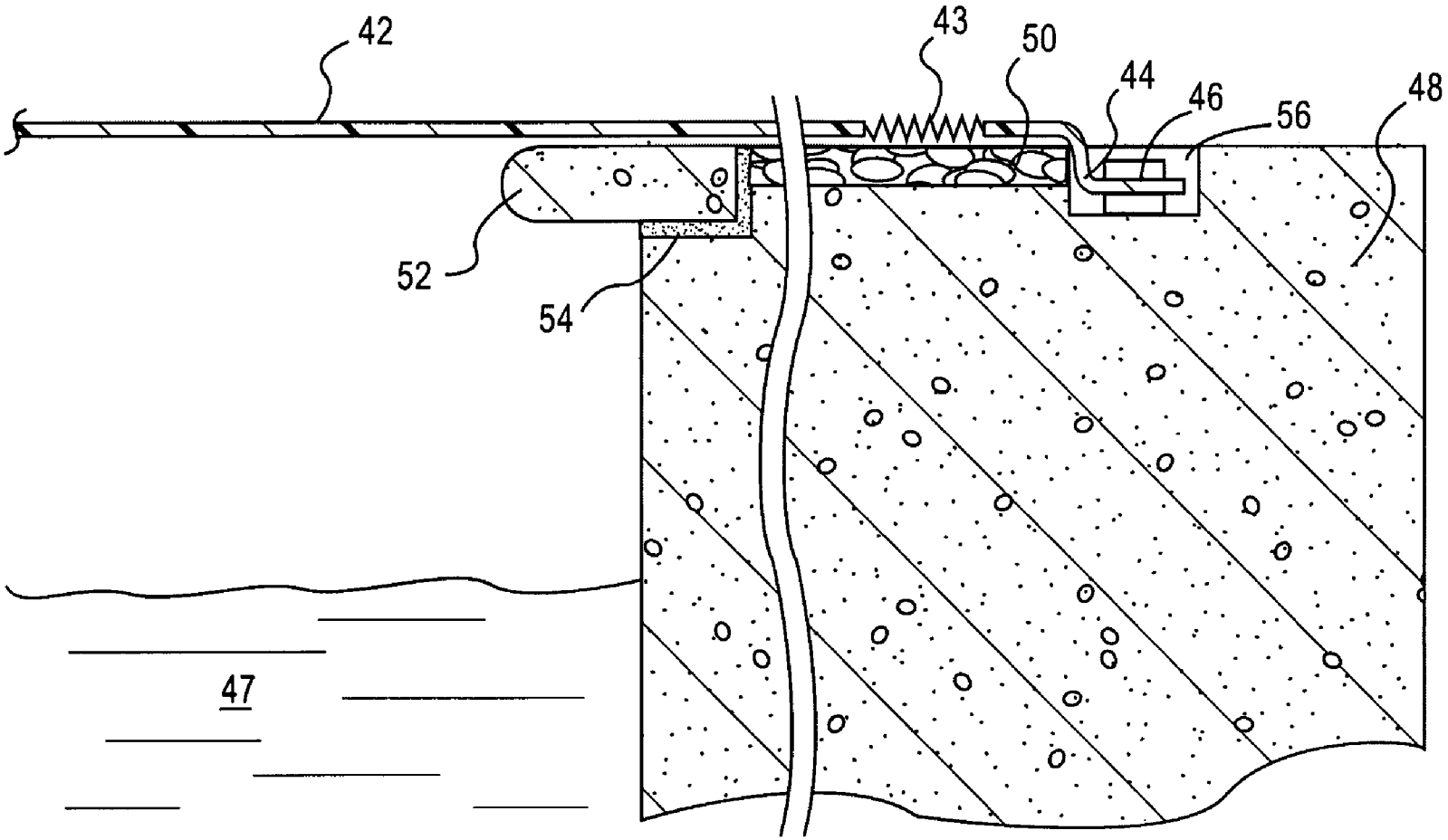
Fig. 2 PRIOR ART
FIG. 2 is a fragmentary side elevational view of a popular prior art pool cover anchoring system of FIG. 1.
Figure 3:
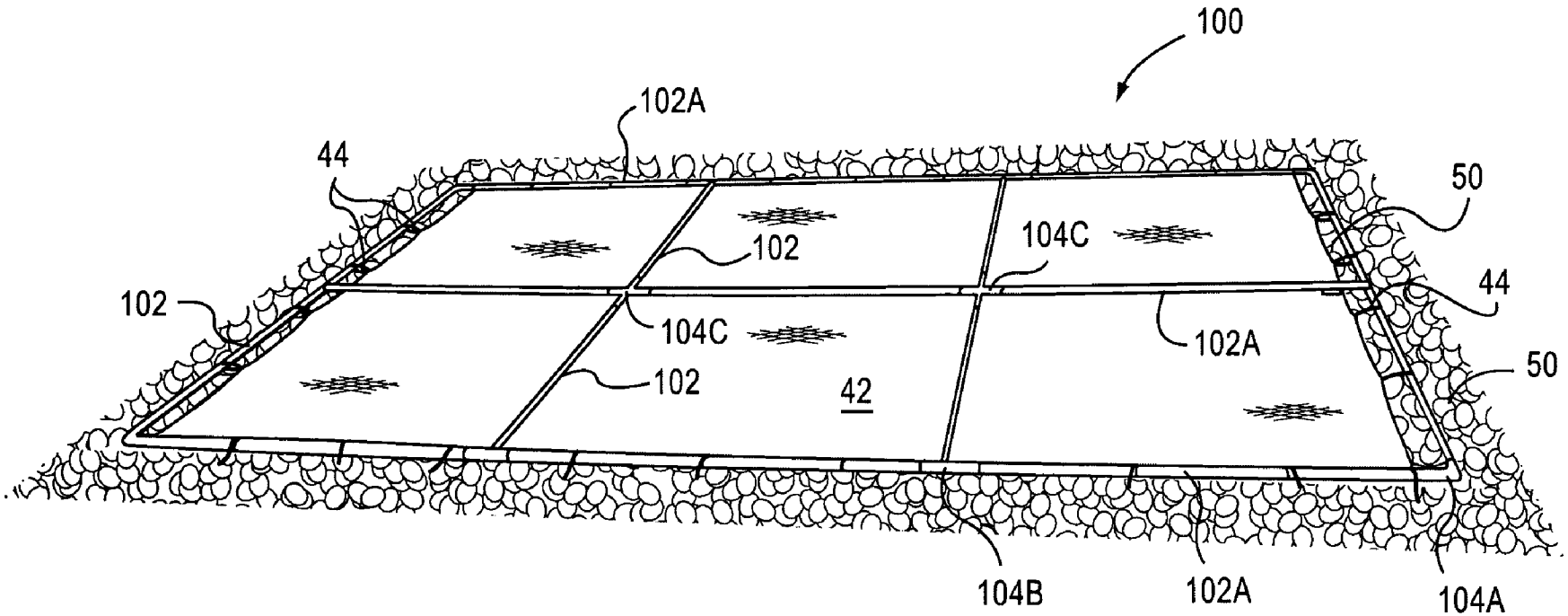
FIG. 3 is a perspective view of an embodiment of the novel pool cover anchoring system of the invention.
Figure 4:
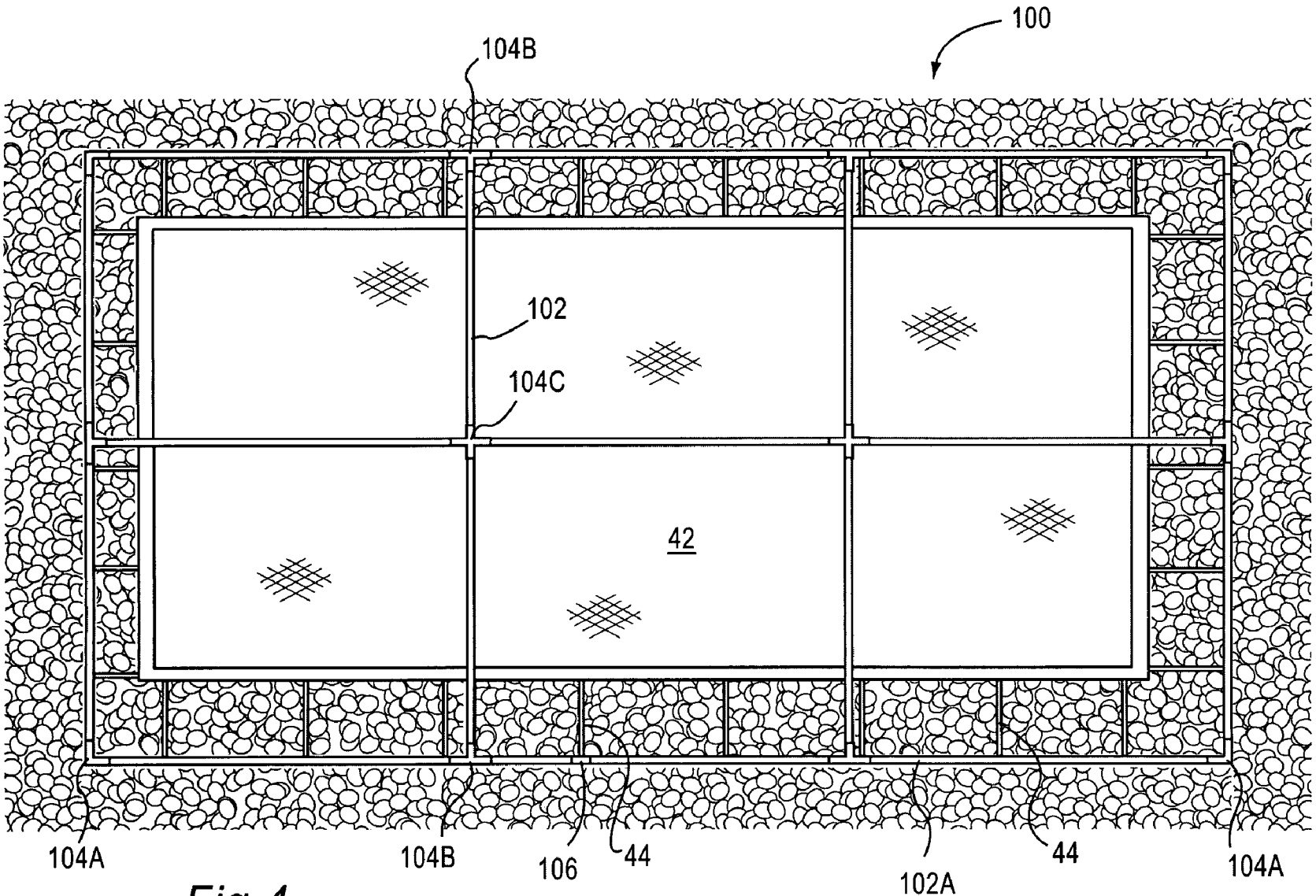
FIG. 4 is a top plan view of the novel pool cover anchoring system of FIG. 3.
Figure 5:
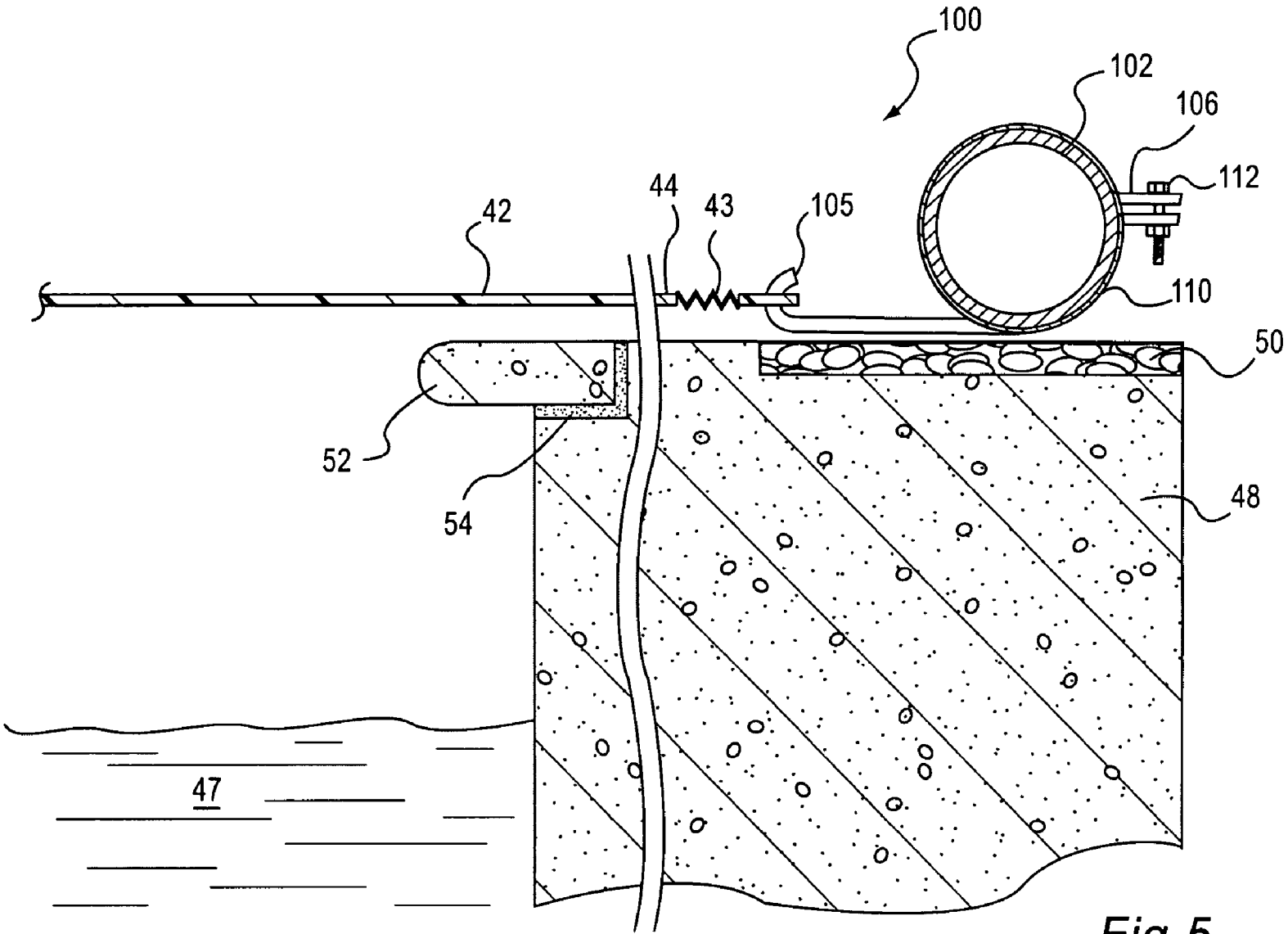
FIG. 5 is a fragmentary side elevational view of a pool cover anchoring system of FIG. 3.
Figure 6:
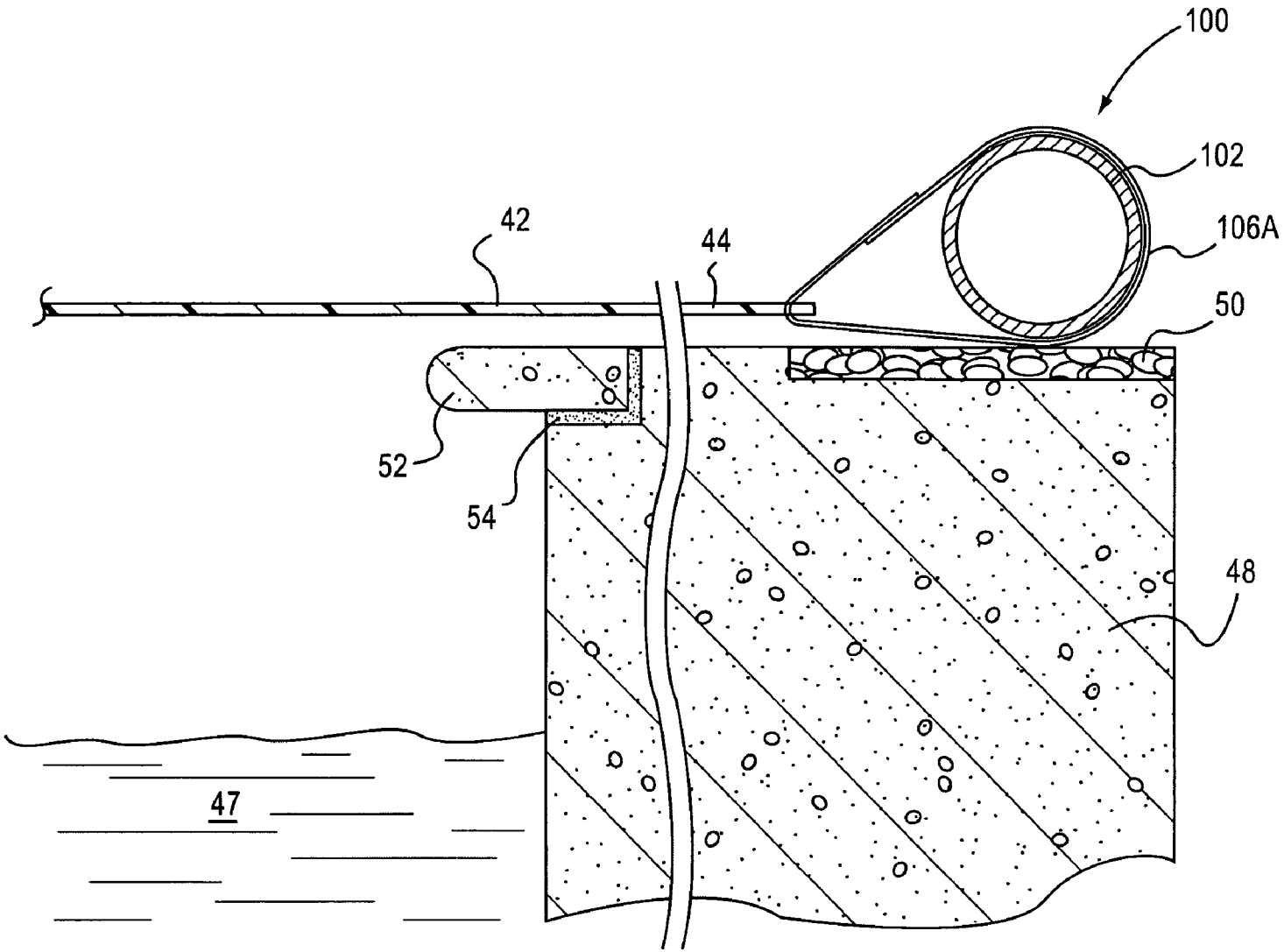
FIG. 6 is a fragmentary side elevational view of an alternative embodiment of a fastener for the pool cover anchoring system of FIG. 4.

Referring now to FIGS. 3, 4 and 5 the novel modular swimming pool support 100 is illustrated which can be repeatedly assembled, disassembled and stored by a homeowner without requiring expensive tools or devices and without requiring specialized pool maintenance technicians. More importantly the novel modular swimming pool support 100 does not require prior art anchoring pins 46 or openings 56 in the masonry and is designed to span the entire swimming pool surrounding coping and tile to the extent needed or desired by the owner by employing a first standardized group of components 102 and 102A loosely connected by a second group of standardized components 104A, 104B and 104C that are tensioned together and held in place by standardized fasteners 106 (FIGS. 4 and 5) and the weight of pool cover 42 as well as any weight of water or debris accumulated on pool cover 42. In those cases where pool cover 42 is designed to filter water through the cover the novel pool support 100 serves to conserve water by draining water into the pool to replenish water 47 in the spring when ice and snow melt.

The modular swimming pool support 100 is designed to accommodate a variety of pool shapes and sizes and cover as much masonry 50 as is desired by the owner. The only limitations to coverage is the size of the pool cover purchased by the owner. Standard size pools are 8 feet by 16 feet, 10 feet by 16 feet, 12 feet by 24 feet, 14 feet by 28 feet, 16 feet by 36 feet, 18 feet by 36 feet, 20 feet by 40 feet, 20 feet by 50 feet and 20 feet by 60 feet. The novel swimming pool cover support is designed to accommodate all these sizes of pools as well as different shaped pools as will be discussed hereinafter in greater detail. As a result of the standardized modular arrangement of the invention an owner can vary the support system to accommodate different sized pool covers as well as using larger pool covers to extend over surrounding masonry.

Figure 7:
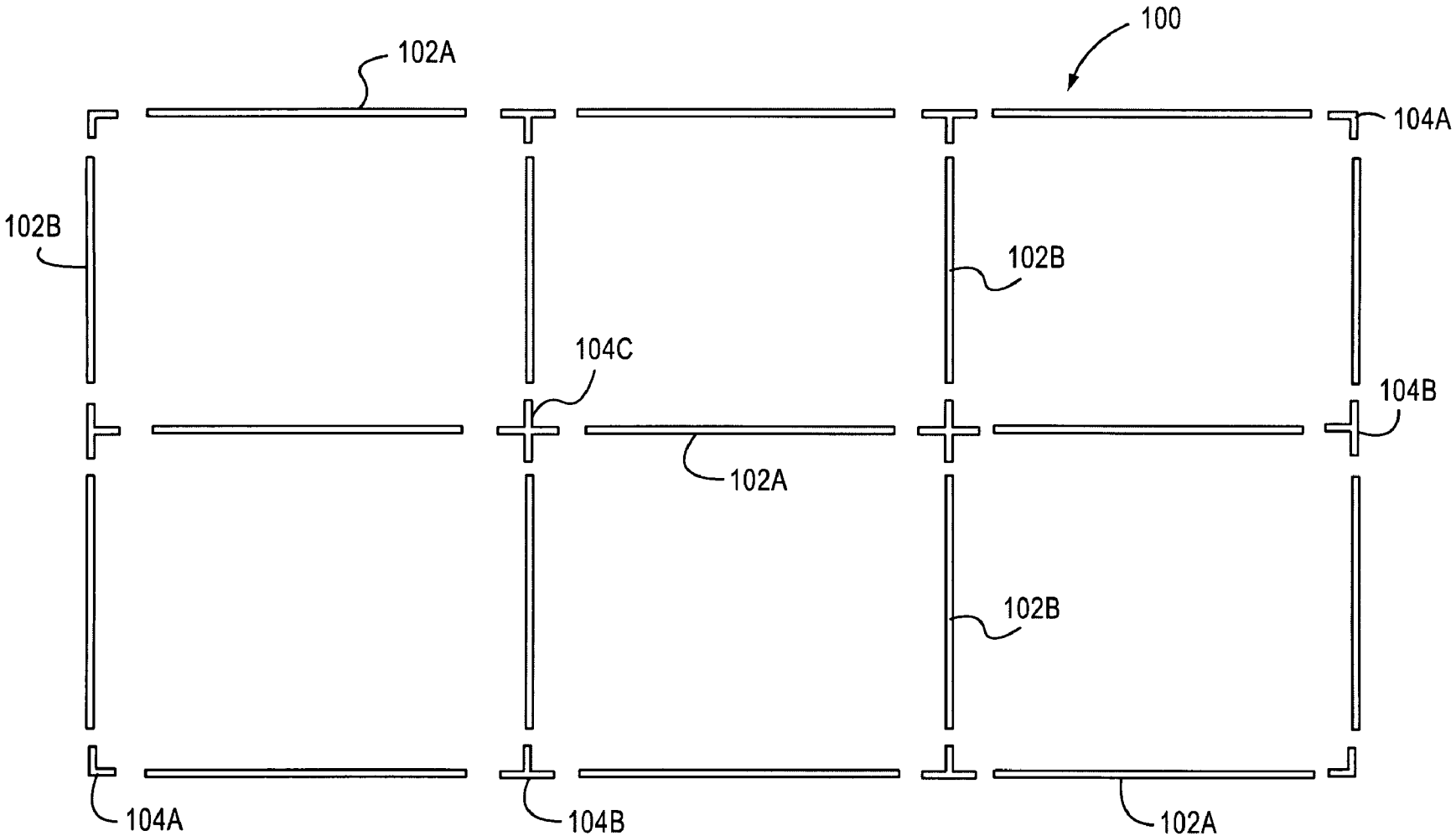
FIG. 7 is an exploded view of the novel pool cover anchoring system of FIGS. 3 and 4.

Referring now to FIGS. 3, 4, 5, 6 and 7 the best mode of the invention is illustrated employing a first group of standardized components 102 and 102A. The first group of standardized components are hollow tubular elements constructed preferably of galvanized steel, stainless steel or elastomer coated iron alloys to prevent rusting and rust stains on the surrounding masonry 50. The first group of standardized components 102 and 102A may have tapered ends to assist in providing a lose fit to the second group of standardized components 104A, 104B and 104C. The preferred lengths of one set of the first group of standardized components 102 is slightly over 8 feet and another set of the first group of standardized components 102A is slightly over 12 feet so that two components 102 of the first set accommodate a 16 foot wide pool and three components 102A of the first set accommodate a 36 foot long poll as illustrated in FIGS. 3, 4 and 7. It will be recognized that other standardized lengths may be provided that are either shorter or longer and the standardized lengths could be around 4 feet and 6 feet to accommodate the pool illustrated in FIGS. 3, 4 and 7.

The first group of standardized components 102 and 102A are preferably hollow to save weight and provide additional strength and in a preferred embodiment are of a substantially circular or of an oval configuration to provide an arch-shaped tube for increased mechanical strength. In order to have the necessary mechanical strength the first group of standardized components should deflect less than one inch at any position around the perimeter of the swimming pool. One way of accounting for mechanical strength is to test a 10 foot section and measure cantilever load. The first group of standardized components should be capable of withstanding a ten foot cantilever load of about 25 pounds or greater. Materials having sufficient strength are rust resistant metals such as stainless steel, galvanized steel, aluminum, copper and alloys of such rust resistant metals or a metal that rusts which has been coated with a rust resistant material. Also high density elastomeric materials such as (PBT) polybutylene terephtalate are capable of withstanding a ten foot cantilever load of about 25 pounds (lbs.) or greater. It will be recognized that other configurations of the standardized components may be used such as triangular, rectangular and other shapes known to those skilled in the art to resist bending while saving weight.

Figure 25:
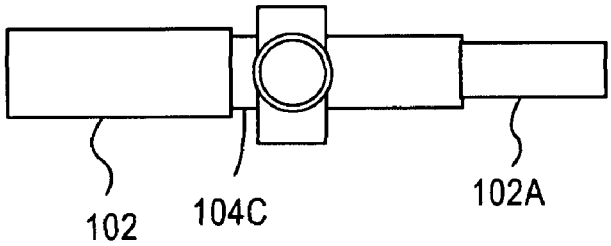
Figure 28:
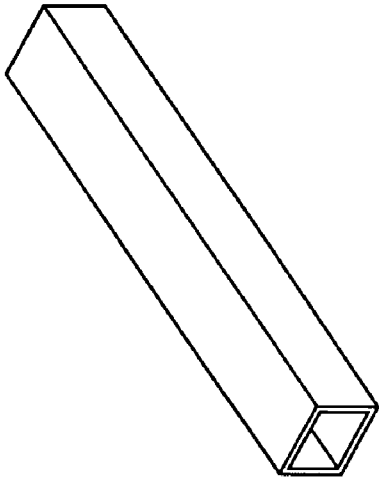
FIGS. 28-30 are perspective views of alternative embodiments for the first group of hollow standardized construction elements of the pool covering anchoring system of the invention.
Figure 29:
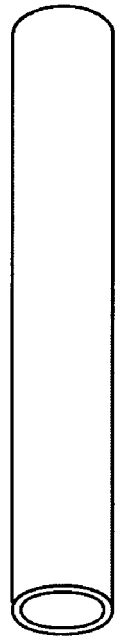

The second group of standardized components 104A, 104B and 104C are coupling members of various shapes which are designed to loosely fit over or inside the first group of standardized components 102 and 102A to provide a variety of size and shape arrangements. As such the second group of standardized components are also constructed of a strong rust resistant material which may be of the same material or a different material as the first group of standardized components and may be made of materials such as galvanized metal, stainless steel or an elastomer coated metal to prevent rusting. The second group of standardized components may be solid where the first standardized component 102 fits over the second standardized component 104C as indicated in FIG. 25. Preferably the second standardized component is hollow and is designed to accept a standardized component 102A also as illustrated in FIG. 25. It should be noted that first standardized components 102 and 102A are preferably of the same diameter and that the apparent differences in diameter in FIG. 25 are for purposes of illustration.

Figure 30:
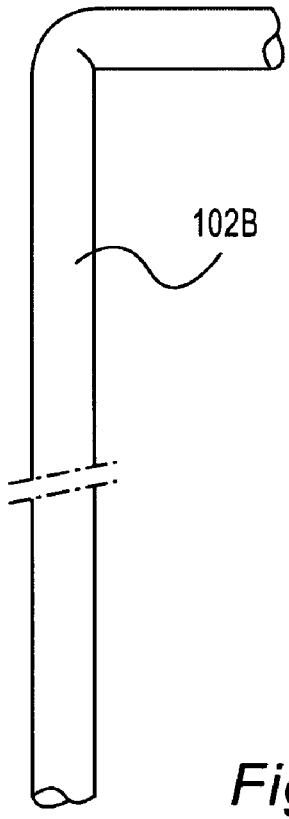

As indicated in FIGS. 3, 4 and 7 the second standardized components 104A, 104B and 104C loosely connect together standard components 102 and 102A to accommodate various sized pools and pool covers. The rectangular configuration of various pool sizes can be accommodated by the three standardized components 104A having an L-shape, standardized component 104B having a T-shape and standardized component 104C having an X or a cross shape. It should however be recognized that standardized component 104A and standardized component 102A can be modified to combine 102A and 104A into a single standardized component 102B as illustrated in FIG. 30. As will be recognized the substitution of standardized component 102B has the advantage of combining two standardized components together and may be utilized in implementing the invention.

Figure 8:
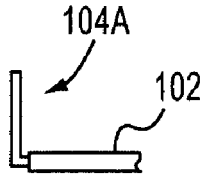
FIGS. 8, 9, 10, 11, 12, 13 and 14 are top plan views of various connectors for assembling components to form various forms of the novel pool cover anchoring system of the invention for accommodating a variety of sizes of pools.
Figure 9:
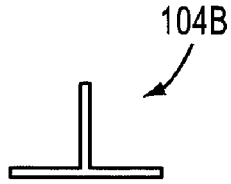
Figure 10:
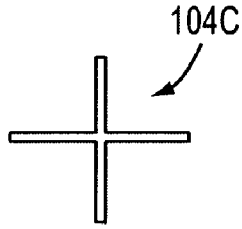

Referring now to FIGS. 10, 11, 12, 13, 14 and 15 the second standardized components 104A (FIG. 8), 104B (FIG. 9) and 104C (FIG. 10) are also preferably hollow and may have round, oval rectangular, triangular or other shape openings that may match or contrast in shape to the openings of the first standardized components. In addition as previously discussed first standardized component 102 can fit over (FIG. 8) or inside each of the second standardized components where the second standardized components are hollow.

Figure 15:
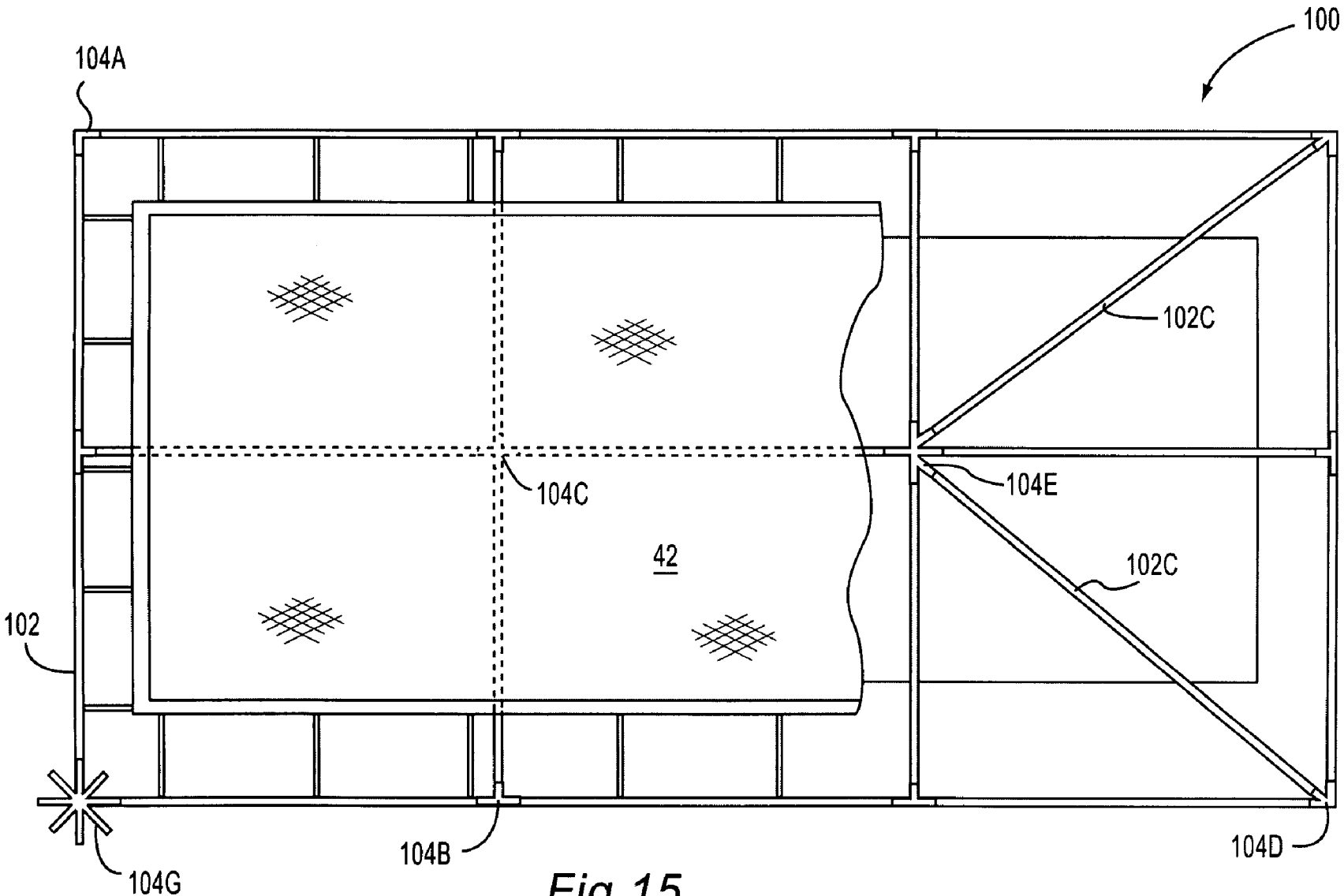
FIG. 15 is a top plan view of an alternative arrangement for the modular components of the pool cover anchoring system of the invention.

The second standardized components however can also have other shapes and configurations for accommodating a broad implementation of the invention for larger size pools and providing additional support for pool cover 42. As illustrated in FIG. 15 second standardized components 104A, 104B and 104C may be employed to provide support for pool cover 42 as previously discussed. However in FIG. 15 second standardized components 104D and 104E of a different configuration may be utilized along with a first standardized component variation 102C.

Figure 11:
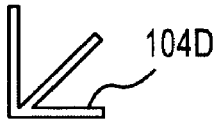
Figure 12:
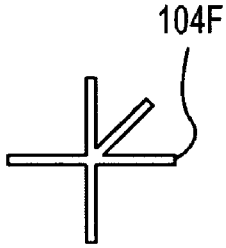
Figure 13:
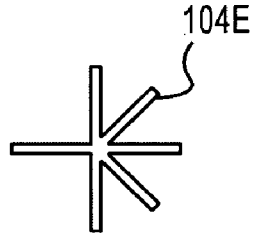
Figure 14:
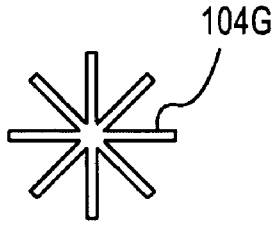

Second standardized component 104D is also shown in FIG. 11 and second standardized component 104E is shown in FIG. 13. These variations 104D and 104E provide additional support for pool cover 42 when combined with first standardized component variation 102C. A further variation of second standardized component 104F is illustrated in FIG. 12 where only one of the first standardized variation 102C is utilized. Also as illustrated in FIG. 15 pool cover 42 can be placed over the novel pool covering system or below it as has heretofore been shown in the drawing.

Figure 16:
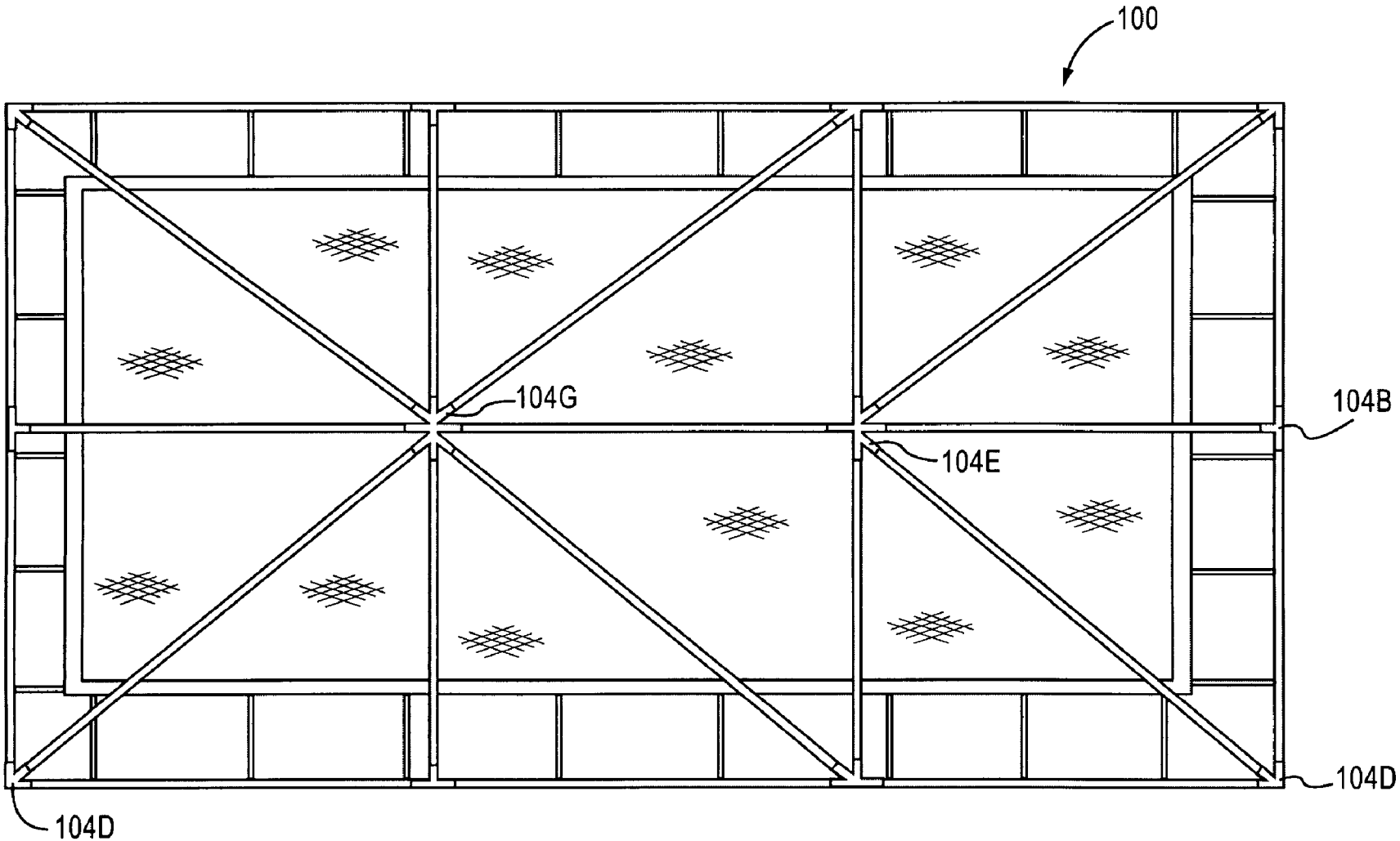
FIG. 16 is a top plan view of a further alternative arrangement for the modular components of the pool cover anchoring system of the invention.
Figure 17:
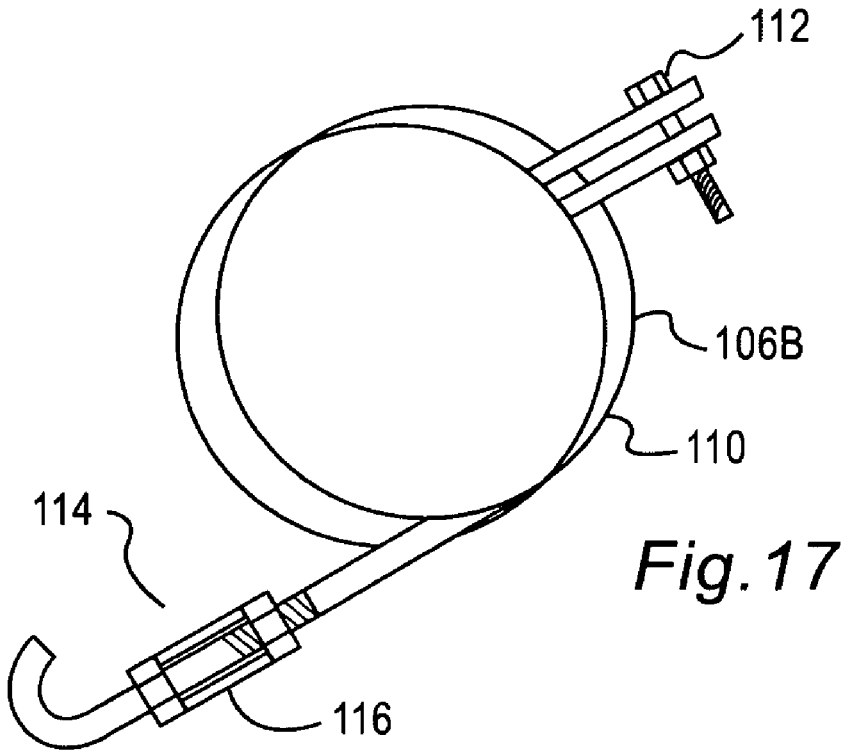
FIG. 17 is a perspective view of an alternative embodiment of a fastener for the novel pool cover anchoring system of the invention.
Figure 18:
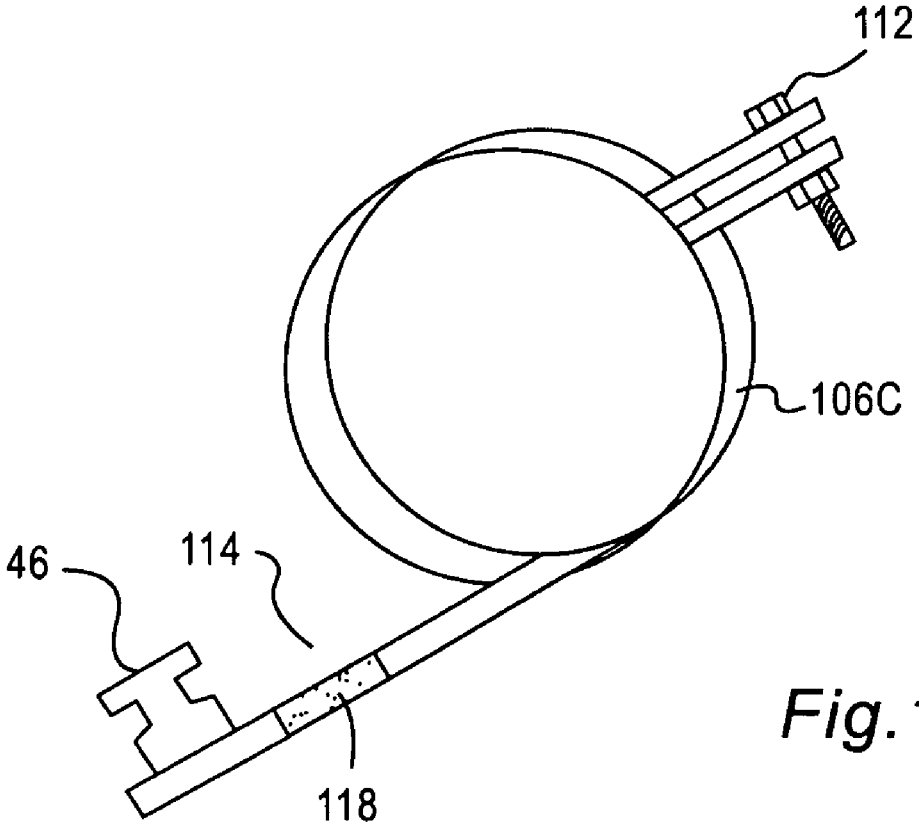
FIG. 18 is a perspective view of a further embodiment of a fastener for the novel pool cover anchoring system of the invention.

The second standardized component 104G (FIG. 14) is a universal standardized component that could be used in place of standardized components 104A to 104F. The standardized component 104G includes all of the angles for square pool covers and could be used and stocked as a universal standardized component in any position with three or more of its openings or arms left open to accommodate other arrangements for the first standardized components 102, 102A and 102B (FIG. 15). Finally universal second standardized component 104G could be used to support a pool cover as illustrated in FIG. 16.

Referring now to FIGS. 4, 5, 6, 17 and 18 a third standardized tensioning component 43 or 106, 106A, 106B and 106C is illustrated. As previously discussed some prior art swimming pool covers include a tensioning device 43 which in some cases are springs and in other cases may be natural or synthetic rubber for tensioning straps 44 to pins 46. When such tensioning devices such as an elastomeric portion, or stainless steel springs are included in the swimming pool cover 42 the tensioning device 43 included with strap 44 can be attached directly to the first standard component 102A, 102B or 102C or other first standard component surrounding the perimeter of the pool. The combination of the first standardized components and second standardized components are then held securely together by compressive forces by the weight of the pool cover 42 which compressive forces increase the tightness by which the components are held together as the accumulated weight of the pool cover and water or debris on the top of the pool cover increases.

However where the prior art pool cover 42 does not include a tensioning device 43 or where the straps 44 are not long enough an extender 106, 106A, 106B and 106C can be utilized as the third tensioning component to hold the first and second standardized components by compressive forces. Extender 106 (FIG. 5) does not include a tensioning device since pool cover 42 has a tensioning device 43 in the form of a spring portion in strap 44. Extender 106 therefore terminates in a hook 105 and relies upon the tensioning device 43 in strap 44. Extender 106 includes a band 110 preferably of stainless steel that is bolted to first standardized component 102 with a bolt 112. Extender 106B (FIG. 17) is otherwise the same as extender 106 except extender 106B includes a tensioning device 114 which may be a turnbuckle 116. Extender 106C is similar to extender 106B and includes a tensioning device 114 disposed between the band 110 and the pool strap mating pin 46. The tensioning device in the case of extender 106C is a rubber section 118.

Figure 19:
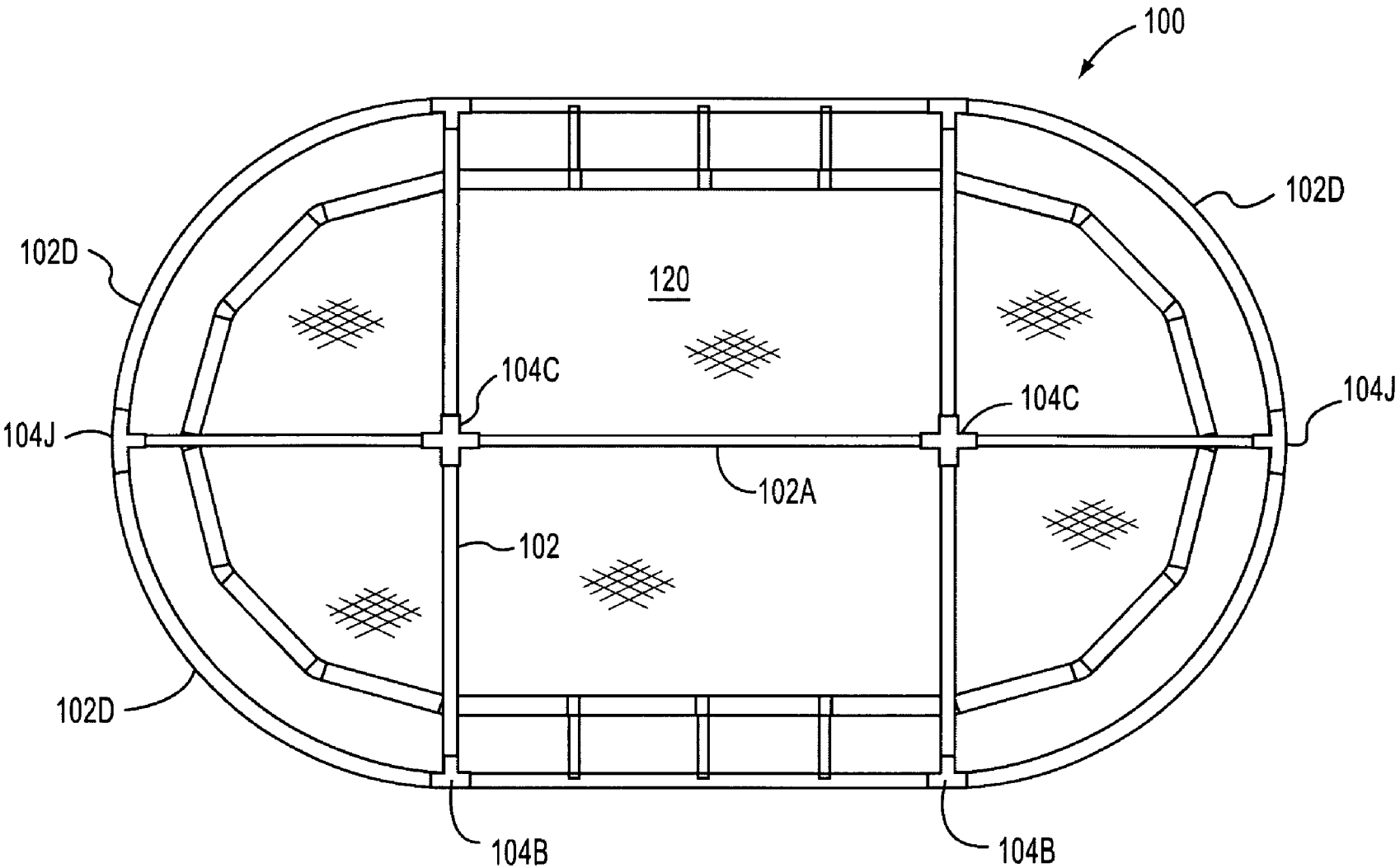
FIG. 19 is a top plan view of an alternative arrangement for the modular components of the pool cover anchoring system of the invention.
Figure 20:
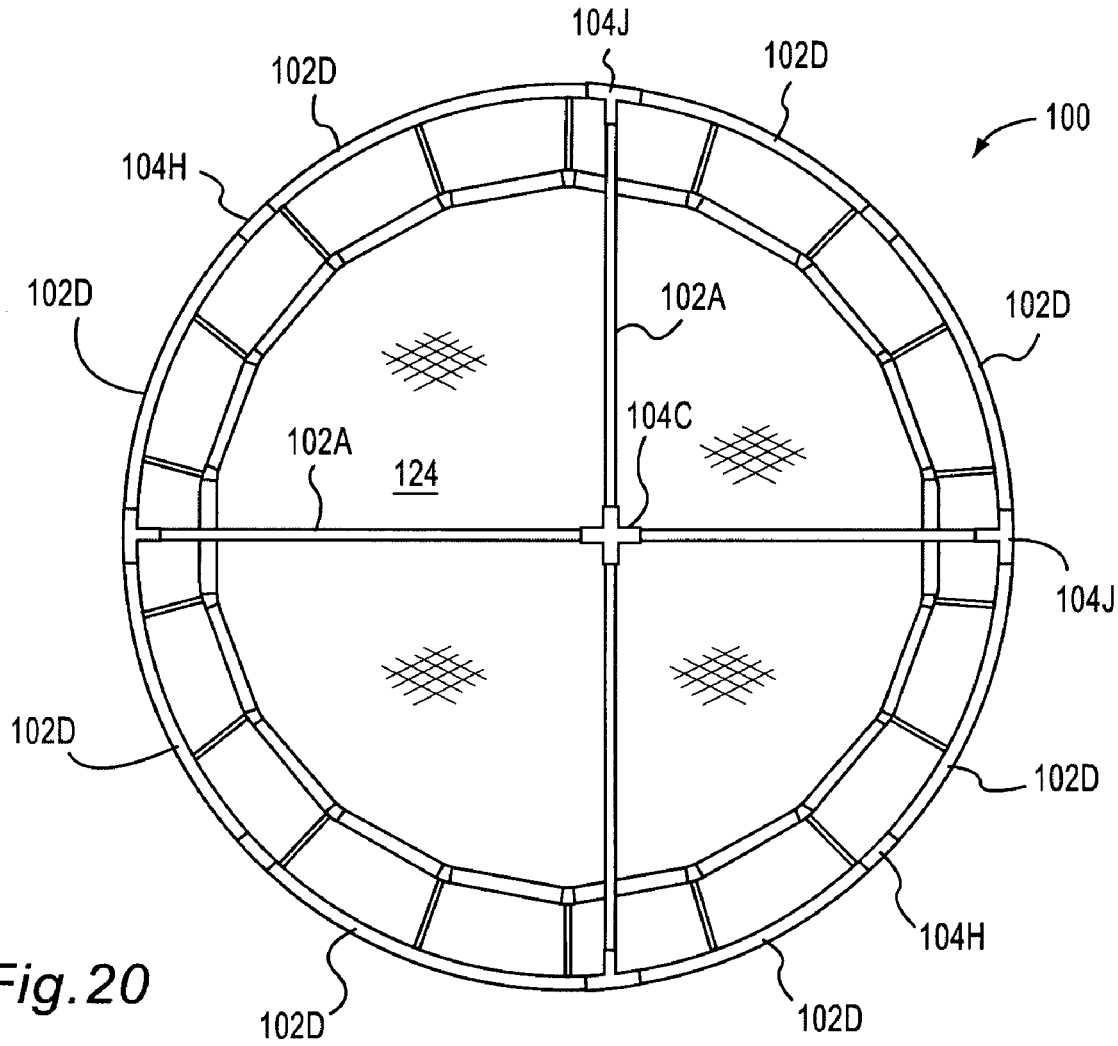
FIG. 20 is a top plan view of a further alternative arrangement of the modular components of the pool cover anchoring system of the invention.

The standardized components can be used to accommodate other shapes of swimming pools and swimming pool covers other than rectangular. Referring now to FIGS. 19 and 20 first standardized components 102 and 102A are joined to curved first standardized components 102D to accommodate oval shaped swimming pool covers 120. In FIG. 20 all curved first standardized components 102D are used for round pool covers 124.

Figure 26:
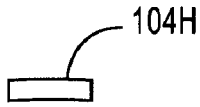
FIG. 21-27 are top plan views of alternative embodiments of various connectors for assembling components for the pool covering anchoring system of the invention to accommodate a variety of sizes and shapes of pools.
Figure 27:
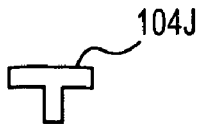
Figure 21:
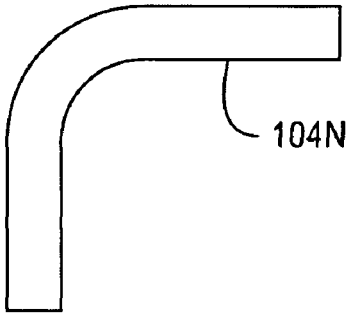
Figure 22:
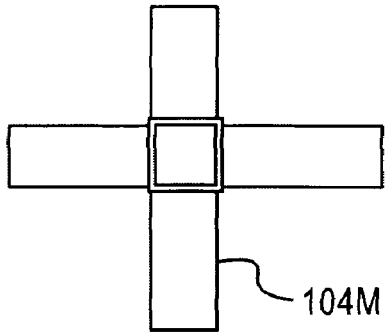
Figure 23:
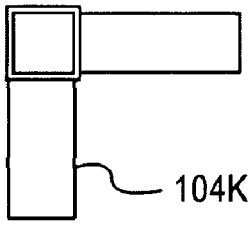
Figure 24:
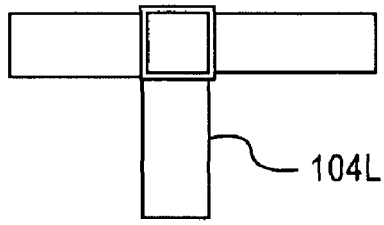

In FIGS. 19 and 20 the second standardized components 104 are modified to accommodate curved first standardized components 102D or both straight and curved standardized components 102D and straight standardized components 102. Curved standardized components 104H (FIG. 26) are used to join all curved standardized components 102D together while partially curved and straight standardized fitting 104J (FIG. 27) is used to interconnect curved first standardized fittings 102D to a straight first standardized fitting 102A. Otherwise the round, oval and square pools are all held together by compression using either tensioning elements in the pool cover strap or in utilizing an extension with tensioning device 106, 106A, 106B or 106C as previously described.

Referring now to FIGS. 21, 22, 23 and 24 various forms of second standardized components are illustrated for connecting together first standardized components. The second standardized components 104K (FIG. 23), 104L (FIG. 24) and 104M (FIG. 22) may all be square in cross section. Since all components fit together loosely but are thereafter when fully assembled are held tightly by compression forces it is possible to fit round elements into square openings or square elements into round holes or have other shaped elements designed to be loosely connected before the elements are tightly held together by compression forces. It is also possible that some second connecting elements like connecting element 104N (FIG. 21) can be of a solid construction to fit in openings in the first standardized components.

The key to the invention is the use of first and second standardized components that are easily assembled and disassembled without tools but which when loosely connected together are tightly held together by compressive forces exerted by the weight of the pool cover. As the weight of the pool cover increases by the weight of water and debris the components respond by compressively tightening the grip between the first and second standardized components.

Those skilled in the art will recognize the invention may be implemented in a variety of ways and not each and every one of the standardized components have to be utilized in practicing the invention. It will be further recognized that the lengths of the first standardized components may be varied to suit particular marketing and display requirements such as desired by installers in contrast to retailers selling directly to the homeowner. These changes in size of the first standardized components as well as the number of second standardized components for example the use of a universal component as heretofore discussed are deemed to be within the scope and teaching of this invention unless otherwise specifically limited by the following claims.

As used herein and in the following claims, the words "comprising" or "comprises" is used in its technical sense to mean the enumerated elements included but do not exclude additional elements which may or may not be specifically included in the dependent claims. It will be understood such additions, whether or not included in the dependent claims, are modifications that both can be made within the scope of the invention. It will be appreciated by those skilled in the art that a wide range of changes and modification can be made to the invention without departing from the spirit and scope of the invention as defined in the following claims.

What is claimed is:

1. In a modular swimming pool cover support device having spanning elements for spanning the length, width, lateral and transverse areas of swimming pools and connecting elements for connecting the spanning elements wherein the improvement comprises a substantially flat planar pool cover frame having a plurality of non telescoping spanning elements of predetermined lengths to accommodate a variety of sizes and shapes of pool covers and a plurality of standardized connecting elements having arms extending at various angles in a single plane capable of releasably sliding over or sliding into ends of the spanning elements to provide a variety of different shapes and configurations which are held together by a tensioning element disposed intermediate an end of a pool cover and along a length of the non telescoping spanning element to resiliently hold together the plurality of non telescoping spanning elements, the plurality of standardized connecting elements and support the weight of the pool cover in a variety of sizes and shapes without requiring anchoring bolts to masonry or fastening to a deck surrounding the swimming pool.

2. The modular swimming pool cover support device of claim 1 wherein said tensioning element is a tensioning member incorporated into the pool cover.

3. The modular swimming pool cover support device of claim 2 further comprising a connector for connecting the pool cover to one of said plurality of non telescoping spanning elements.

4. The modular swimming pool cover support device of claim 3 wherein said connector includes a tensioning device.

5. The modular swimming pool cover support device of claim 1 wherein said plurality of standardized non telescoping spanning elements are straight or curved.

6. The modular swimming pool cover support device of claim 5 wherein said plurality of standardized non telescoping spanning elements are constructed of a galvanized metal, stainless steel or a metal covered with an elastomeric material.

7. The modular swimming pool cover support device of claim 1 wherein at least one of said plurality of standardized non telescoping connecting elements is L-shaped, T-shaped, X-shaped or star-shaped.

8. A modular apparatus for supporting a cover comprising:

(a) a plurality of spanning elements having standardized lengths constructed from a rust-resistant metal or rust-resistant metal alloy, galvanized metal or a metal covered by a rust-resistant material;

(b) a plurality of standardized connecting elements having two or more projecting arms projecting at different angles in a single plane for accepting at least two spanning elements of said plurality of spanning elements; and (c) a resilient tensioning element for holding said plurality of spanning elements and said group of standardized connecting elements together in a framework for supporting a cover, said resilient tensioning element disposed intermediate an end of said cover and connected to at least one of said plurality of spanning elements along said standardized lengths of said plurality of spanning elements to resiliently hold together the plurality of standardized connecting elements and support the weight of the cover in a variety of sizes and shapes without requiring anchoring bolts to masonry or fastening to a deck surrounding a swimming pool.

9. The modular apparatus of claim 8 wherein said plurality of spanning elements are straight.

10. The modular apparatus of claim 8 wherein said plurality of standardized connecting elements are L-shaped, T-shaped, X-shaped or star-shaped.

11. The modular apparatus of claim 10 wherein said plurality of standardized connecting elements is a star-shaped universal connecting element.

12. The modular apparatus of claim 8 wherein said plurality of spanning elements are straight or curved.

13. The modular apparatus of claim 12 wherein at least one member of said plurality of standardized connecting elements has at least two curved ends.

14. The modular apparatus of claim 13 wherein at least one member of said plurality of standardized connecting elements has at least two curved ends and at least one straight end.

15. The modular apparatus of claim 14 wherein said at least one member of said plurality of standardized connecting elements has at least two curved ends and a plurality of straight ends.

16. The modular apparatus of claim 8 wherein said tensioning element includes at one end a hook and at the other end an adjustable band for engaging said plurality of spanning elements.

17. The modular apparatus of claim 16 wherein said tensioning element includes a turnbuckle disposed intermediate said hook and said adjustable band.

18. A modular pool cover support device held together by compressive forces exerted by the weight of a pool cover comprising:

(a) a plurality of substantially hollow components having predetermined lengths and composed of a rust-resistant metal alloy, a galvanized metal, or a metal covered by a rust resistant material or an elastomeric material capable of withstanding a ten foot cantilever load of about 25 lbs. or greater;

(b) a group of connectors having one or more projecting arms projecting at one or more different angles in a single plane and loosely fitting on at least one end of said plurality of substantially hollow components and providing for the connection of said plurality of substantially hollow components having predetermined lengths;

(c) a plurality of tensioning devices disposed around a perimeter of an assembled group of said plurality of said substantially hollow components; and (d) a pool cover for providing weight on said plurality of tensioning devices and compressive forces on said plurality of said substantially hollow components and said group of connectors to hold the pool cover support device together wherein one end of each of said plurality of tensioning devices is connected to the pool cover and the other end of said plurality of tensioning devices is connected to one of said plurality of substantially hollow components or said group of connectors to resiliently hold together the plurality of standardized connecting elements and support the weight of the pool cover in a variety of sizes and shapes without requiring anchoring bolts to masonry or fastening to a deck surrounding a swimming pool.

19. The modular pool cover support device of claim 18 wherein said plurality of substantially hollow components are curved or straight.

20. The pool cover support device of claim 19 wherein at least one of said group of connectors is a star-shaped universal connector.

* * * * *